US008418617B2

(12) United States Patent
Rastegar et al.

(10) Patent No.: US 8,418,617 B2
(45) Date of Patent: Apr. 16, 2013

(54) SETBACK AND SET-FORWARD INITIATED INERTIAL IGNITERS AND ACTIVATED ELECTRICAL SWITCHES

(75) Inventors: Jahangir S. Rastegar, Stony Brook, NY (US); Richard T. Murray, Patchogue, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 150 days.

(21) Appl. No.: 12/774,324

(22) Filed: May 5, 2010

(65) Prior Publication Data

US 2010/0307362 A1 Dec. 9, 2010

Related U.S. Application Data

(60) Provisional application No. 61/175,775, filed on May 5, 2009.

(51) Int. Cl.
*F42C 15/24* (2006.01)
*F42C 19/06* (2006.01)

(52) U.S. Cl.
USPC ..... 102/247; 102/216; 102/249; 102/252; 102/253; 102/272

(58) Field of Classification Search ..... 102/247, 102/252, 253, 216, 248, 249, 272, 274
See application file for complete search history.

(56) References Cited

U.S. PATENT DOCUMENTS 7,437,995 B2 * 10/2008 Rastegar et al. ..... 102/216
8,061,271 B2 * 11/2011 Murray et al. ..... 102/216

* cited by examiner

*Primary Examiner* — James Bergin

(57) ABSTRACT

A method of igniting one of a pyrotechnic material and primer during or after an all fire setback acceleration. The method including: positioning a mass element along an inclined surface; biasing the mass element in a direction into the inclined surface such that the mass element traverses the inclined surface upon the all fire setback acceleration against the biasing; drawing the mass element toward one of a pyrotechnic material and primer with the biasing after the mass element traverses the inclined surface. The method can further include delaying the drawing until the mass element experiences a set forward acceleration. The delaying can include drawing the mass element into a delay well after the mass element traverses the inclined surface and drawing the mass element across a delay wedge when the mass element experiences the set forward acceleration.

15 Claims, 6 Drawing Sheets

SETBACK AND SET-FORWARD INITIATED INERTIAL IGNITERS AND ACTIVATED ELECTRICAL SWITCHES

CROSS-REFERENCE TO RELATED APPLICATIONS

This application claims benefit to U.S. Provisional Application 61/175,775 filed on May 5, 2009, the contents of which are incorporated herein by reference.

BACKGROUND OF THE INVENTION

1. Field of the Invention

The present invention is directed to inertial igniters for thermal batteries or other pyrotechnic type initiated devices for gun-fired munitions and mortars that are initiated as a result of either firing setback acceleration or set-forward acceleration and for electrical switches that are activated (opened or closed) as a result of either firing setback acceleration or set-forward acceleration.

2. Prior Art

Thermal batteries represent a class of reserve batteries that operate at high temperature. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters require electrical energy, thereby requiring an onboard battery or other power sources. The second class of igniters, commonly called "inertial igniters", operates based on the firing acceleration. The inertial igniters do not require onboard batteries for their operation and are thereby often used in high-G munitions applications such as in gun-fired munitions and mortars.

In general, the inertial igniters, particularly those that are designed to operate at relatively low impact levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

SUMMARY OF THE INVENTION

Accordingly, an inertial igniter is provided. The inertial igniter comprising: a body; a mass element; a spring element attached at one end to the body and at another end, at least indirectly, to the mass element; and an inclined surface upon which the mass element moves from a resting position to an all-fire position; wherein upon the body experiencing a firing setback acceleration, the mass element travels at least across the inclined surface against a force of the spring element to ignite one of a pyrotechnic material and a primer.

The body can include a channel in communication with the inclined surface and positioned under the inclined surface in a direction opposite to the firing setback acceleration, the mass element traveling in the channel towards the one of the pyrotechnic material and primer with the force of the spring element. The channel can include the one of the pyrotechnic material and primer. The mass element can include a first pyrotechnic material and the channel includes a second pyrotechnic material. The channel can include one or more flame exit ports for directing flames resulting from contact between the first and second pyrotechnic materials.

The spring element can be a tensile spring or a compression spring.

The channel can further include a delay well and delay wedge, the delay well being between the inclined surface and delay wedge such that the mass element enters the delay well during the all fire setback acceleration and cannot traverse the delay wedge until the body experiences a set forward acceleration, after traversing the delay wedge, the mass element contacting the one of the pyrotechnic material and primer.

The mass element can be connected to the spring element through a link, the link being connected at one end by the mass element and at another end by a rotary joint, the spring element being connected to the link along a length of the link.

The spring element can be a torsional spring and the mass element comprises two mass elements disposed on each end of a link member which rotates about a rotary joint positioned along a length of the link member, the torsional spring being connected at one end to the link member, the inclined surface comprising two inclined surfaces corresponding to the two mass elements, wherein the torsional spring biases the mass elements up the inclined surfaces in a direction of the all fire setback acceleration.

Each of the inclined surfaces can include a stop for limiting movement of the mass elements up the inclined surfaces in the direction of the all fire setback acceleration.

The mass element can be connected to the spring element through a link, the link being connected at one end by the mass element and having first and second rotary joints, the spring element being connected to the link along a length of the link and the first rotary joint having a female portion and male portion positioned along an edge of the link member when the body is at rest, the second rotary joint having one of a female portion male portion positioned along the edge of the link member and the other of the female portion and male portion offset from the edge when the body is at rest.

Also provided is a method of igniting one of a pyrotechnic material and primer during or after an all fire setback acceleration. The method comprising: positioning a mass element along an inclined surface; biasing the mass element in a direction into the inclined surface such that the mass element traverses the inclined surface upon the all fire setback acceleration against the biasing; and drawing the mass element toward one of a pyrotechnic material and primer with the biasing after the mass element traverses the inclined surface.

The method can further comprise delaying the drawing until the mass element experiences a set forward acceleration. The delaying can comprise drawing the mass element into a delay well after the mass element traverses the inclined surface and drawing the mass element across a delay wedge when the mass element experiences the set forward acceleration.

The method can further comprise directing a flame resulting from the mass element contact with one of the pyrotechnic material and primer to a thermal battery.

Still further provided is an electrical switch comprising: a body; a mass element; a spring element attached at one end to the body and at another end, at least indirectly, to the mass element; and an inclined surface upon which the mass element moves from a resting position to an all-fire position; wherein upon the body experiencing a firing setback acceleration, the mass element travels at least across the inclined surface against a force of the spring element to contact an electrical contact and close a circuit.

The mass element can be at least partially formed of a conductive material and the spring element is conductive.

The body can include a channel in communication with the inclined surface and positioned under the inclined surface in a direction opposite to the firing setback acceleration, the mass element traveling in the channel towards the electrical contact with the force of the spring element.

The spring element can a compression spring or tension spring.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 1:
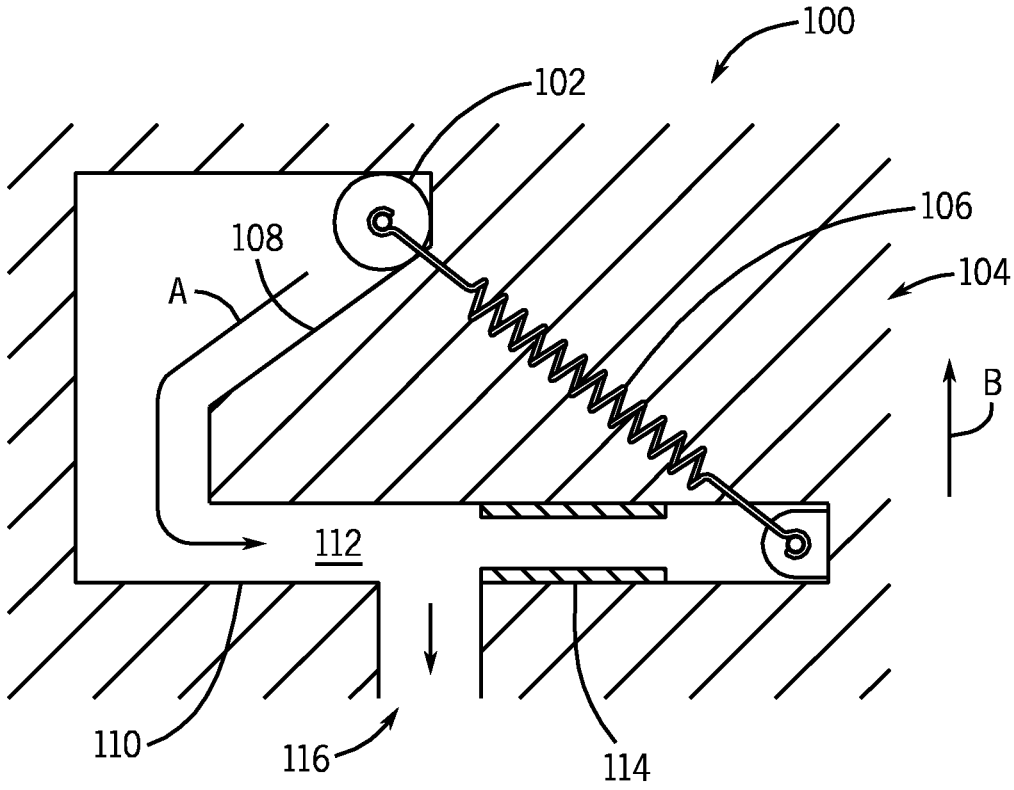
FIG. 1 illustrates a first embodiment of an inertial igniter.

A first embodiment of an inertial igniter is shown in FIG. 1, the inertial igniter of the first embodiment generally being referred to with reference numeral 100. In the first embodiment, a mass element 102 (striker mass) is attached to a body 104 of the inertial igniter 100 via a spring element 106. The spring element 106 can be preloaded in tension so that it would not freely or upon the application of a threshold force would not extend enough to allow the mass element 102 to move down along the indicated path A. As a result, the mass element 102 is essentially positioned as shown in FIG. 1 at rest or upon the application of less than all-fire (setback) acceleration level in the direction of the indicated arrow B. Upon all-fire acceleration, the setback acceleration acts upon the inertia of the mass element 102, and if it lasts long enough, it overcomes the resistance of the spring element and the wedge interface 108, to extend the spring 106 enough to allow the mass element to follow the indicated path A downwards along the wedge interface 108. Once the mass element 102 reaches the bottom surface 110 of the body 104 of the inertial igniter 100, the force exerted by the spring element 106 acts on the mass element 102 to pull the same into the provided corridor 112. During the latter process, the potential energy stored in the spring element is (partially or wholly) transferred to the mass element 102 as kinetic energy.

The mass element 102 then initiates a pyrotechnic material 114 positioned in the corridor 112. When the process of initiating the pyrotechnic material 114 is by a rubbing action, a first part of the pyrotechnic is provided on the mass element 102 and the second part of the pyrotechnic material is disposed in the corridor 112. Then as the mass element passes through the corridor 112, the two parts of the pyrotechnic material rub against each other, thereby initiating the pyrotechnic material 114. The generated flame and sparks, etc., are then channeled through one or more ports 116 into a thermal battery, or the like (not shown) for its activation.

Figure 2:
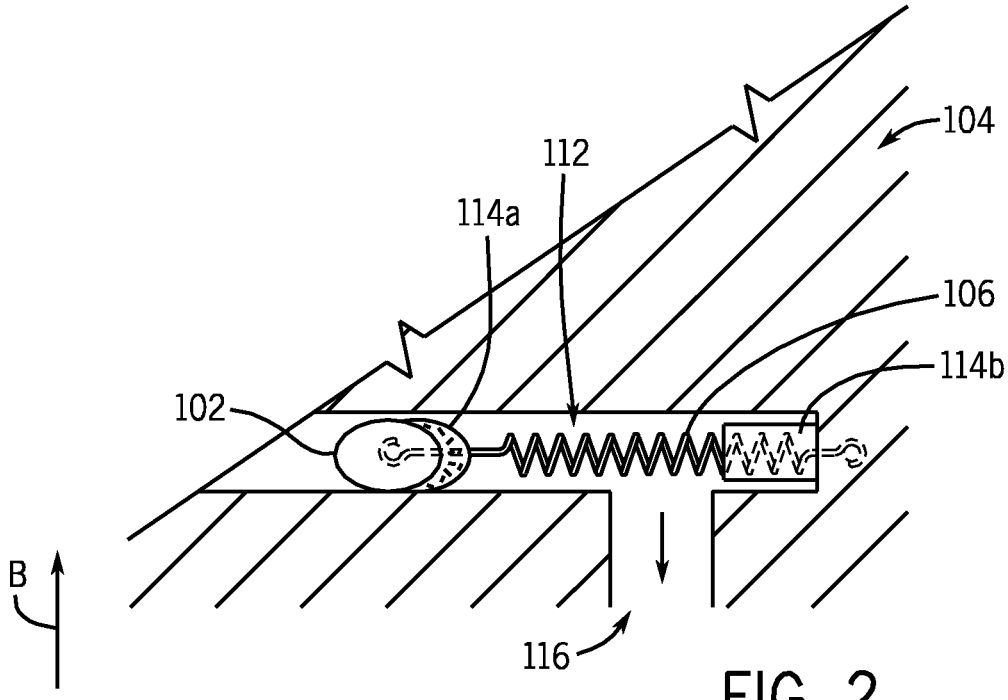
FIG. 2 illustrates a variation of the inertial igniter of FIG. 1.

Alternatively, the mass element 102 can acts as a striker mass. The mass element 102 can be provided with one part 114*a* of a two part pyrotechnic material as shown in FIG. 2. The second part 114*b* of the two parts pyrotechnic is provided in the corridor 112, such as at the end of the corridor 112. Then once the mass element 102 is released into the corridor 112 as a result of the applied setback acceleration over a long enough length of time, the first pyrotechnic part 114*a* on the striker mass 102 strikes the second pyrotechnic part 114*b*, thereby initiating the igniter. Pinching points are preferably provided on the striker mass and inside the second pyrotechnic part (not shown) to facilitate ignition. The generated flame and sparks are then channeled through the port 116 into the thermal battery, or the like (not shown) for its activation.

Alternatively, the mass element 102 (FIGS. 1 and 2) may strike a primer, thereby initiating the primer. The generated flame and sparks are then channeled through the port 116 into the thermal battery, or the like (not shown) for its activation.

Figure 3:
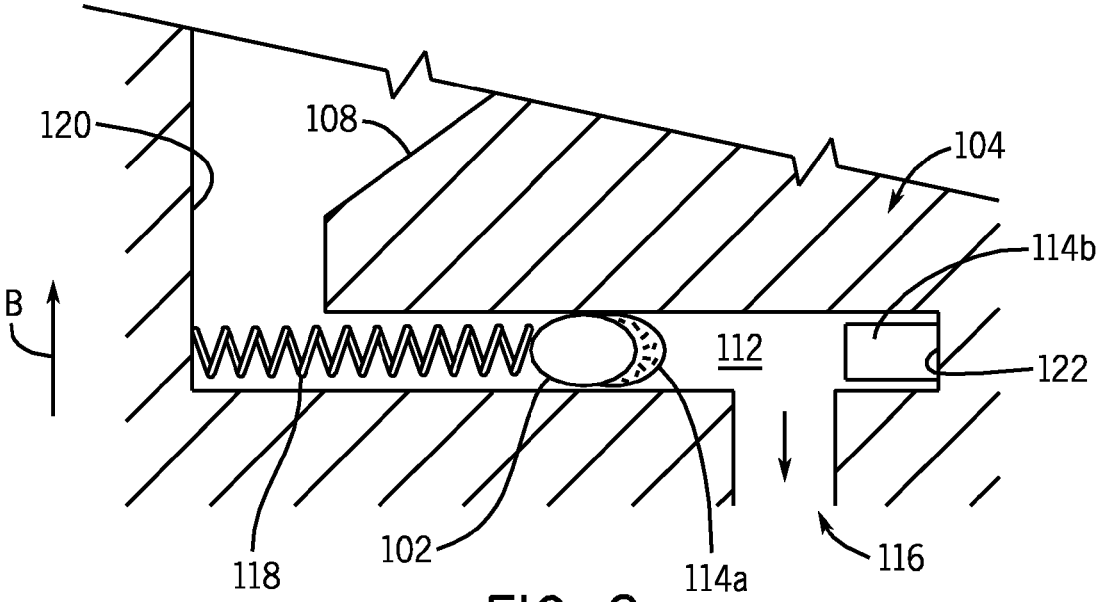
FIG. 3 illustrates another variation of the inertial igniter of FIG. 1.

Alternatively, the tensile spring element 106 shown in the embodiments of FIGS. 1 and 2 can be replaced by a compressive spring element 118. The compressive spring element 118 can be attached on one side to the mass element 102 and on the other end attached to a wall 120 of the inertial igniter housing 104 as shown in FIG. 3. The wall 120 can be opposite from a wall 122 which supports the second pyrotechnic material 114*b*. Once the mass element 102 is released into the corridor 112 as a result of the applied setback acceleration over a long enough length of time, the first pyrotechnic part 114*a* on the striker mass 102 strikes the second pyrotechnic part 114*b*, thereby initiating the igniter. The generated flame and sparks are then channeled through the port 116 into the thermal battery, or the like (not shown) for its activation.

The design of the inertial igniter embodiments of FIG. 1-3 may also be used to construct electrical switches which are activated similarly by the firing setback acceleration. The design and operation of such electrical switches is shown by its application to the embodiment of FIG. 3 as observed in the schematic of FIG. 4. It is however appreciated that the embodiments of FIGS. 1 and 2 may be similarly used to construct similar electrical switches. Similar features from FIGS. 1-3 are denoted with similar reference numerals, except with a 200 series.

In the electrical switch 200, the mass element 202 also acts as a first electrical contact 2, which is released into the corridor 212 as a result of the applied setback acceleration over a long enough length of time. The first electrical contact, which can be the mass element 202 itself or a portion thereof, reaches a second electrical contact 222 shown in FIG. 4, thereby allowing electrical current to flow to/from the first switching wire 224 through the first and second electrical contacts 202, 222 to/from the second switching wire 226. The second electrical contact 222 can be provided with adequate insulation material 228 to ensure that it stays insulated from the body of the electrical switch 200, which may be electrically conductive but is preferably made of electrically non-conductive material. In this embodiment, the compressive spring 218 is considered to be electrically conductive but can alternatively be provided with a conductive component.

The embodiments of FIGS. 1-3 are designed for initiation as a result of the firing setback acceleration that the inertial igniter is subjected over a long enough period of time, usually around 4-10 msec. In certain applications, particularly in munitions applications that involve very high firing setback accelerations, it is highly desirable to delay ignition until the round has exited or has nearly exited the barrel. Such a delay will ensure that the thermal battery is still in its full solid state during the entire setback acceleration, which would in turn ensure survival of very high G setback acceleration levels.

Figure 5:
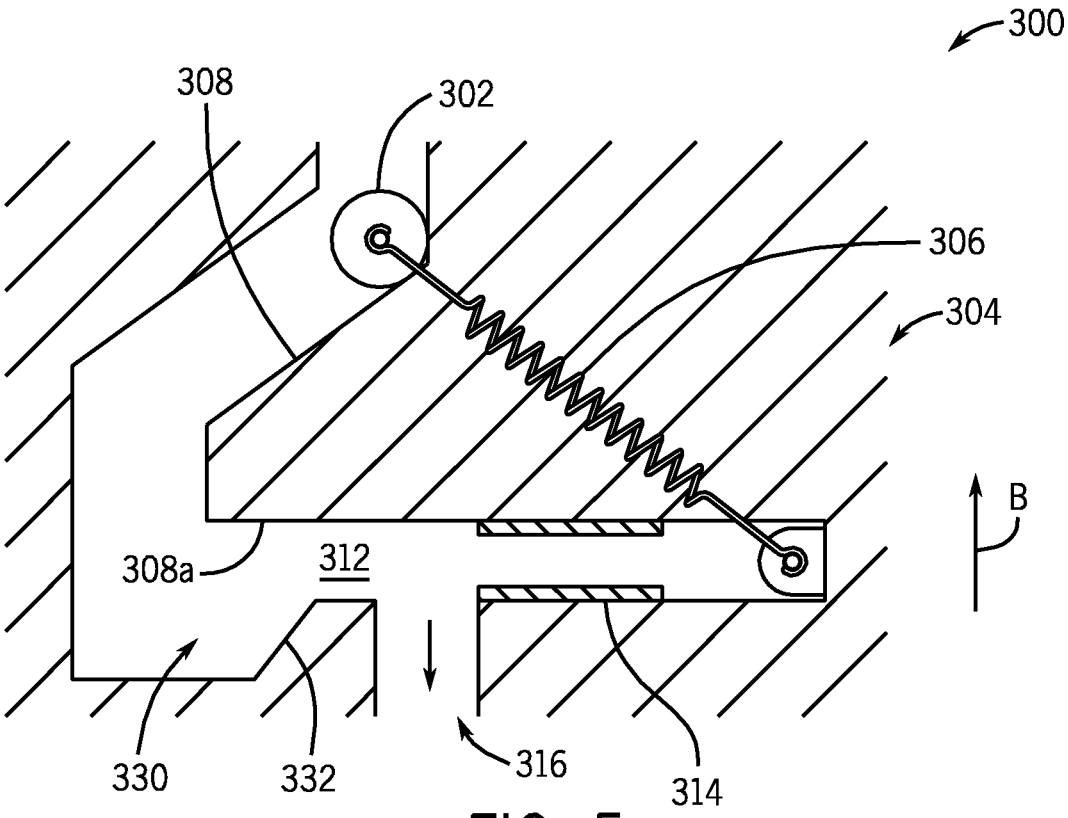
FIG. 5 illustrates a second embodiment of an inertial igniter.

The inertial igniter 300 embodiment shown schematically in FIG. 5 is similar to the embodiment of FIG. 1 is designed to delay ignition until the round experiences its set-forward acceleration upon exiting the gun barrel. The embodiment of FIG. 5 is similar to the embodiment of FIG. 1, with similar features from the inertial igniter of FIG. 1 being denoted with similar reference numerals, except with a 300 series. In the inertial igniter 300 of FIG. 5, after overcoming the first wedge interface 308 as a result of the setback acceleration, the mass element 302 travels to a delay well 330 and is held there by the setback acceleration. Then when the round begins to experience a set-forward acceleration in the direction opposite to that of the setback acceleration (FIG. 5), the mass element 302 is able to overcome a delay wedge 332 in communication with the delay well 330 and be pulled into the corridor 312 containing the pyrotechnics 314 by the stretched tensile spring element 306. It is noted that while the mass element 302 is "trapped" in the delay well 330 by the setback acceleration, its positioning beneath a portion 308*a* of the primary wedge 308 ensures that the mass element 302 is not ejected back to its start position above the primary wedge 308 upon the application of the set-forward acceleration. As discussed with regard to the inertial igniter of FIG. 1, when the process of initiating the pyrotechnic material 314 is by a rubbing action, a first part of the pyrotechnic is provided on the mass element 302 and a second part of the pyrotechnic material 314 is disposed in the corridor 312. Then as the mass element 302 passes through the corridor 312, the two parts of the pyrotechnic material rub against each other, thereby initiating the pyrotechnic material 314. The generated flame and sparks, etc., are then channeled through the port 316 into the thermal battery, or the like (not shown) for its activation.

Alternatively, the mass element 302 can act as a striker mass similar to that shown in the schematic of FIG. 2. The second part of the two parts pyrotechnic is provided in the corridor 312, preferably at the end of the corridor 314 and is activated as was previously described for the embodiment of FIG. 2.

Alternatively, as also discussed with the first embodiment of inertial igniters above, the mass element 302 may strike a primer, thereby initiating the primer. The generated flame and sparks are then channeled through the port 316 into the thermal battery, or the like (not shown) for its activation.

Alternatively, the tensile spring element 306 shown in the embodiment of FIG. 5 can be replaced by a compressive spring element as shown and described for the embodiment of FIG. 3.

As still yet another alternative, the inertial igniter of FIG. 5 can be used as an electrical switch, similar to that described above with regard to FIG. 4 to provide a time delay for closing the circuit.

Figure 6A:
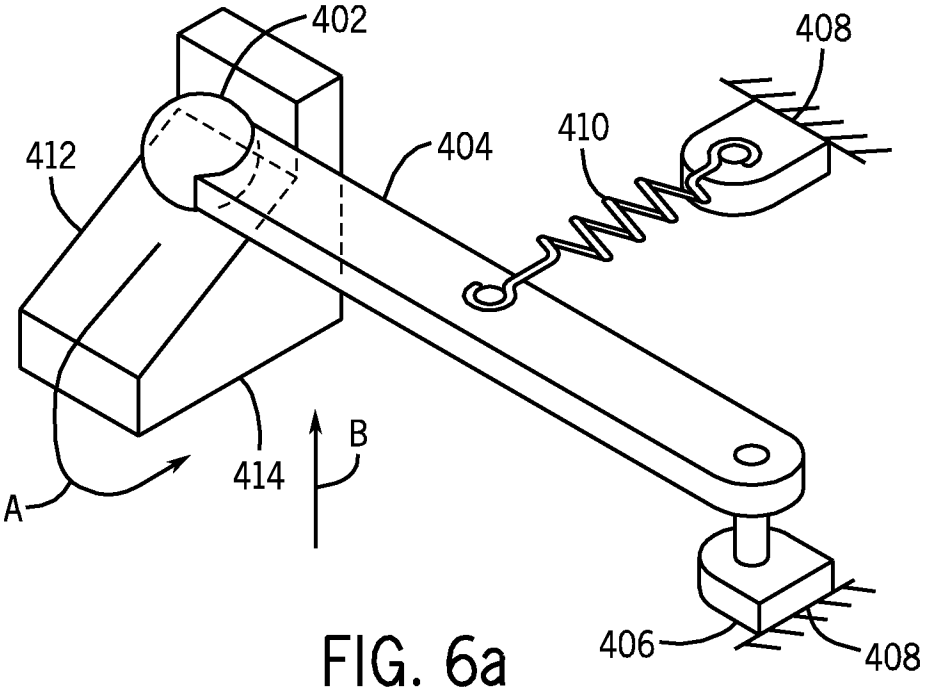
FIGS. 6*a* and 6*b* illustrate a perspective and plan view, respectively, of a third embodiment of an inertial igniter.
Figure 6B:
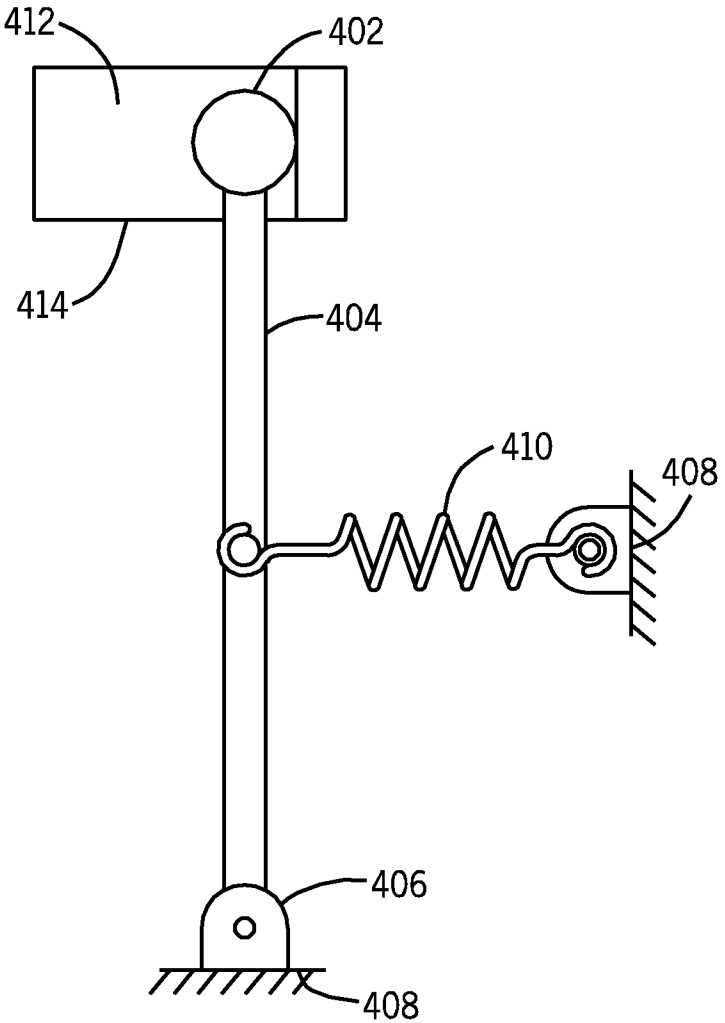

Another embodiment of an inertial igniter is shown in a perspective schematic of FIG. 6*a* (a plan view of the device is shown on in FIG. 6*b*). In this embodiment, the mass element 402 is connected to a link 404, which is allowed to rotate sideways and downward at its double rotary joint connection 406 to the body 408 of the inertial igniter (here shown as the ground). A tensile spring element 410 is used to maintain the link 404, thereby the mass element 402 at its rest position shown in FIG. 6*a* at its right hand most position on an inclined surface 412. The spring element 410 can be preloaded in tension so that during all no-fire (accidental) accelerations in the direction of the setback acceleration and corresponding time durations (accidental impulse levels and acceleration profiles), the mass element 402 does not travel all the way down the inclined surface 412. However, upon the application of all-fire setback acceleration profile, the mass element 402 overcomes the resistance of the inclined surface 412 and tensile force of the spring element 410 and follows the path A indicated in FIG. 6*a* to pass beneath the wedge 414. At this point, the potential energy stored in the spring element 410 begins to accelerate the mass element (and the link 404) to the right. The mass element (with first part pyrotechnic material) can then initiate the inertial igniter by either rubbing against the second part pyrotechnic material (similarly to that shown in FIG. 1) or by impacting the second part pyrotechnic material (similarly to that shown in FIG. 2) or by impacting a primer. The generated flame and sparks are then channeled through a port into the thermal battery, or the like for activation thereof (similarly to that shown in FIGS. 1-3).

Figure 7:
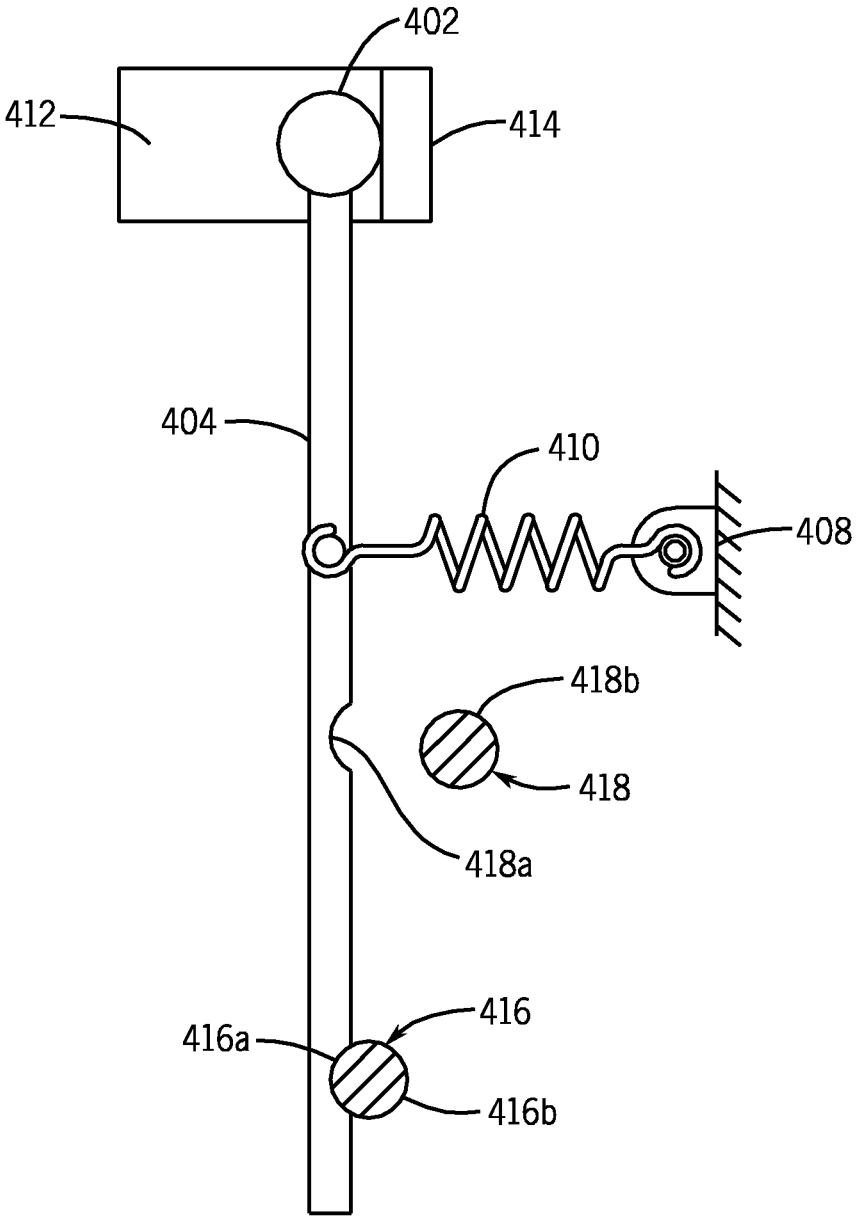
FIG. 7 illustrates a first variation of the inertial igniter of FIGS. 6*a* and 6*b*.

An variation of the embodiment of FIG. 6 is shown in the schematic of FIG. 7. In the embodiment of FIG. 7, as compared to the embodiment of FIG. 6*b*, at rest, a female portion 416*a* of a primary rotating joint 416 on the link element 404 is engaged with its male counterpart 416*b*. Then as a result of the setback acceleration, the mass element 404 rotates essentially on a circle centered at the primary joint 416 and downward over the inclined surface 412 of the wedge element 414. During this time, the tensile spring element 410 (which can be preloaded in tension at rest) is further extended, thereby further storing potential energy. Once the mass element 402 passes the wedge element 414, the mass element 402 moves under the wedge element 414 and the spring element 410 begins accelerating it to the right as previously described for the embodiment of FIG. 6*a*. At some point, however, a female portion 418*a* of a secondary rotary joint 418 on the link 404 reaches a fixed male portion 418*b* of the secondary rotary joint 418. Then from that point on, the link 404 begins rotating about the secondary rotary joint 418. Thus, the radius of the link 404 and mass element 402 rotation is reduced, therefore proportionally increasing the rotational speed of the link 402 and thereby the velocity of the mass element 402. As a result, a smaller mass element 402 can be used to achieve initiation of the pyrotechnic materials as compared to the embodiment of FIG. 6*a*.

Alternatively, the tensile spring element shown in the embodiments of FIGS. 6*a* and 7 can be replaced by a compressive spring element similar to that shown and described for the embodiment of FIG. 3.

Figure 8A:
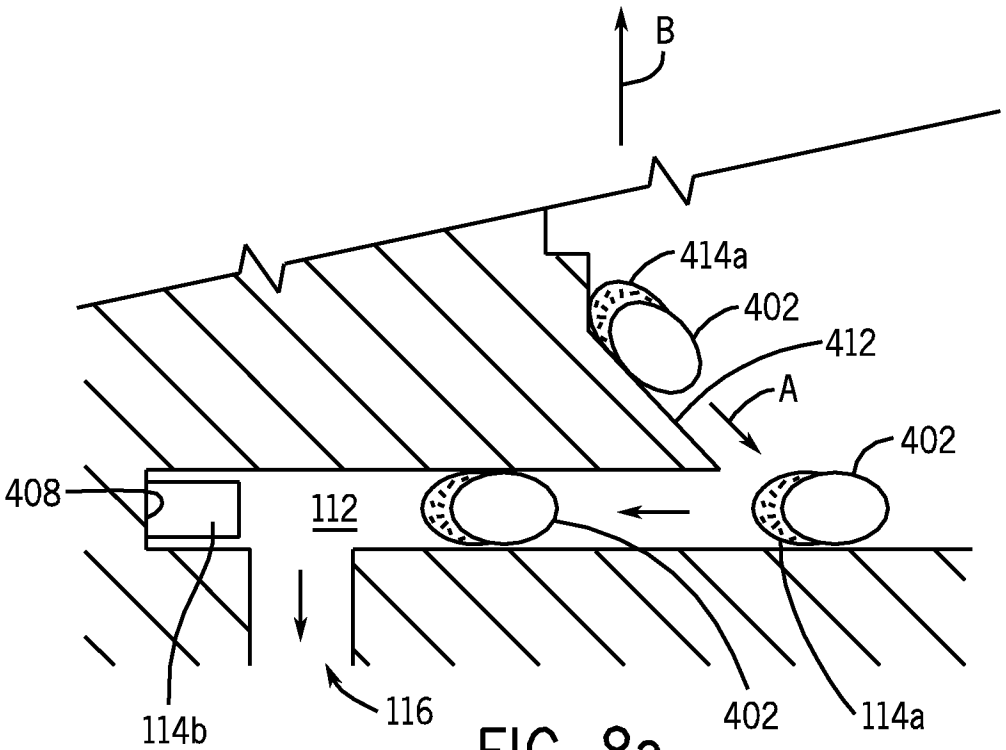
FIGS. 8*a* and 8*b* illustrate a side view and plan view, respectively, of a second variation of the inertial igniter of FIGS. 6*a* and 6*b*.
Figure 8B:
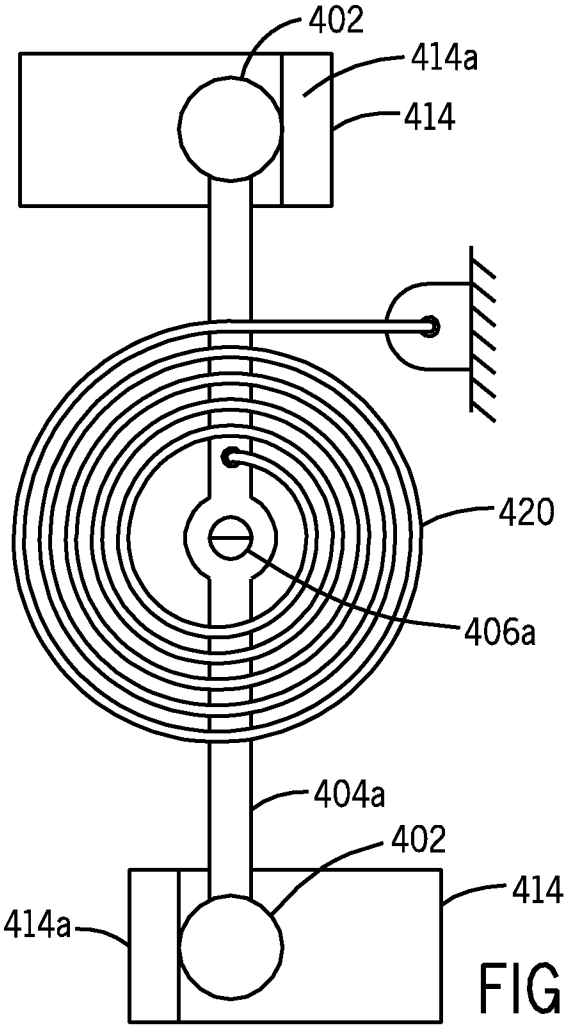

A second variant of the embodiment of FIG. 6*a* is shown in FIGS. 8*a* and 8*b*. The embodiment of FIGS. 8*a* and 8*b* differs from the embodiment of FIG. 6*a* for at least the following two reasons. Firstly, the tension spring element of FIG. 6*a* is replaced by a torsional spring 420. Secondly, instead of one wedge surface, two (or more) wedge surfaces 412 are each used for a striker mass 402 to ride as the inertial igniter is subjected to setback acceleration in the direction of the indicated arrow B (alternatively, only one wedge element may also be used). The link element 404*a* is similarly attached to the body 408 of the inertial igniter by a joint 406*a* that allows for rotation of the link about the vertical axis (perpendicular to the plane of the illustration) as well as displace up and down (in and out of the plane of the illustration), thereby constituting a so-called "cylindrical joint". The torsional spring element 420 is used to maintain the link 404*a*, thereby the mass element 402 at its rest position shown in FIG. 8*a*, resting against a striker stop 414*a* on the inclined surface 412. The torsional spring element 420 can be preloaded so that during all no-fire (accidental) accelerations in the direction of the setback acceleration B and corresponding time durations (accidental impulse levels and acceleration profiles), the mass elements 402 do not travel all the way down the wedge inclined surface 412. However, upon the application of all-fire setback acceleration profile, the mass elements 402 overcome the resistance of the wedge 414 and the resisting torque of the torsional spring element 420 and follow the path A indicated by the arrow in FIG. 8*a* and pass beneath the wedge 414. As the mass elements 402 travel down the wedge slope, the link 404*a* is forced to rotate in the counterclockwise direction and more potential energy is stored in the torsional spring 420. At this point, the potential energy stored in the torsional spring element 420 begins to accelerate the mass elements 402 towards the second part pyrotechnic materials 414*b* (as the link is accelerated in rotation in the clockwise direction). The mass elements 402 (with first part pyrotechnic material 414*a*) can then initiate the inertial igniter by either rubbing against the second part pyrotechnic material 414*b* (as shown in FIG. 1) or by impacting the second part pyrotechnic material 414*b* (as shown in FIG. 8*a*) or by impacting a primer. The generated flame and sparks can then be channeled through a port(s) 116 into the thermal battery, or the like for activation thereof.

Figure 4:
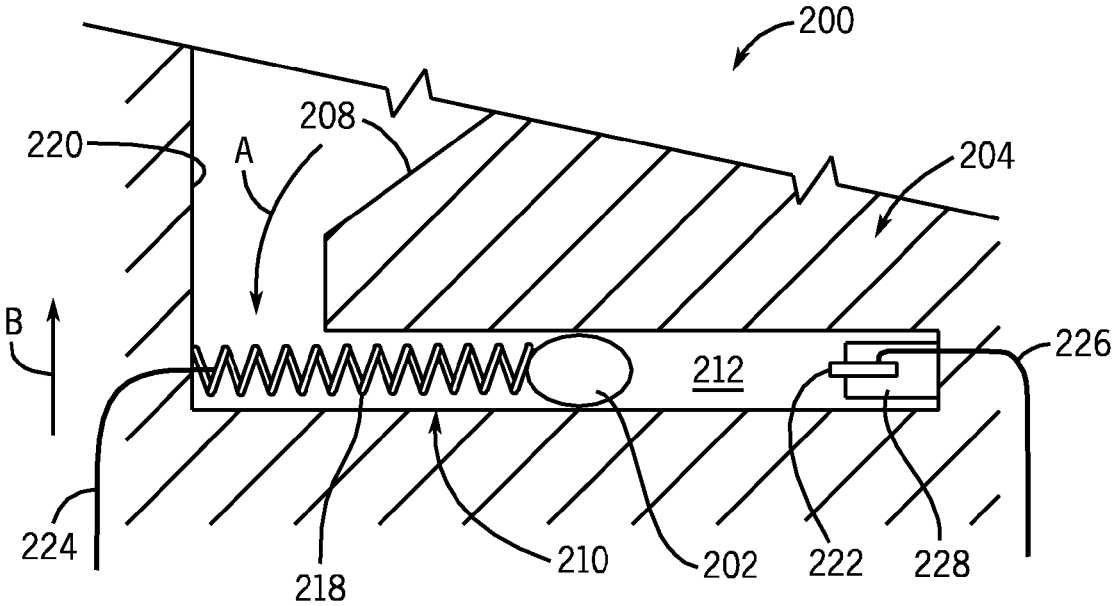
FIG. 4 illustrates a first embodiment of an electrical switch.

In a manner similar to those of the embodiment of FIG. 4, the inertial igniter of the embodiments of FIGS. 6*a*, 7 and 8*a* may be converted into an electrical switch that is activated by the firing setback acceleration.

In alternative embodiments to those of FIGS. 6*a*, 7 and 8*a*, by providing delay wells and delay well wedges similar to that shown in the embodiment of FIG. 5, these embodiments can be constructed to initiate during the set-forward acceleration of the round as was previously described for the embodiment of FIG. 5.

It is noted that in all the embodiments shown, the spring elements may be preloaded (in tension for the tensile springs and in compression for the compression springs) at rest. However, the spring elements in these embodiments can be substantially at their free lengths at rest. The latter spring element state can be safer and prevent accidental activation. In addition, the level and duration of the acceleration in the direction of the setback acceleration (impulse level) that would actuate these devices, i.e., move the mass elements past the indicated wedge surface and thereby initiate activation, are designed to be higher that all no-fire (no-actuation for the electrical switch embodiments) acceleration and duration (impulse) levels to satisfy the device safety requirements against accidental initiation, such as due to accidental dropping of the devices on hard surfaces from heights of usually 5-7 feet.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An inertial igniter comprising:

a body;

a mass element;

a spring element attached at one end to the body and at another end, at least indirectly, to the mass element; and an inclined surface upon which the mass element moves from a resting position to an all-fire position, the inclined surface being inclined with respect to a firing setback acceleration;

wherein upon the body experiencing the firing setback acceleration, the mass element travels at least across the inclined surface against a force of the spring element to a portion of the body in which one of a pyrotechnic material and a primer is disposed, the mass being drawn through the portion into the one of the pyrotechnic material and primer with the force of the spring element to ignite the one of the pyrotechnic material and the primer.

2. The inertial igniter of claim 1, wherein the portion comprises a channel in communication with the inclined surface and positioned under the inclined surface in a direction substantially orthogonal to the firing setback acceleration, the mass element traveling in the channel towards the one of the pyrotechnic material and primer with the force of the spring element.

3. The inertial igniter of claim 2, wherein the channel further includes a delay well and delay wedge, the delay well being between the inclined surface and delay wedge such that the mass element enters the delay well during the all fire setback acceleration and cannot traverse the delay wedge until the body experiences a set forward acceleration, after traversing the delay wedge, the mass element contacting the one of the pyrotechnic material and primer.

4. The inertial igniter of claim 1, wherein the mass element includes a first pyrotechnic material and the channel includes a second pyrotechnic material.

5. The inertial igniter of claim 4, wherein the portion includes one or more flame exit ports for directing flames resulting from contact between the first and second pyrotechnic materials.

6. The inertial igniter of claim 1, wherein the spring element is a tensile spring.

7. The inertial igniter of claim 1, wherein the spring element is a compression spring.

8. The inertial igniter of claim 1, wherein the mass element is connected to the spring element through a link, the link being connected at one end by the mass element and at another end by a rotary joint, the spring element being connected to the link along a length of the link.

9. The inertial igniter of claim 1, wherein the spring element is a torsional spring and the mass element comprises two mass elements disposed on each end of a link member which rotates about a rotary joint positioned along a length of the link member, the torsional spring being connected at one end to the link member, the inclined surface comprising two inclined surfaces corresponding to the two mass elements, wherein the torsional spring biases the mass elements up the inclined surfaces in a direction of the all fire setback acceleration.

10. The inertial igniter of claim 9, wherein each of the inclined surfaces include a stop for limiting movement of the mass elements up the inclined surfaces in the direction of the all fire setback acceleration.

11. The inertial igniter of claim 1, wherein the mass element is connected to the spring element through a link, the link being connected at one end by the mass element and having first and second rotary joints, the spring element being connected to the link along a length of the link and the first rotary joint having a female portion and male portion positioned along an edge of the link member when the body is at rest, the second rotary joint having one of a female portion male portion positioned along the edge of the link member and the other of the female portion and male portion offset from the edge when the body is at rest.

12. A method of igniting one of a pyrotechnic material and primer during or after an all fire setback acceleration, the method comprising:

positioning a mass element along an inclined surface of a body, the inclined surface being inclined with respect to the all fire setback acceleration;

biasing the mass element in a direction into the inclined surface such that the mass element traverses the inclined surface upon the all fire setback acceleration against the biasing, the biasing comprising attaching one end of a spring element at least indirectly to the mass element and attaching another end of the spring element to the body; and after the mass element traverses the inclined surface, drawing the mass element to a portion of the body in which the one of the pyrotechnic material and primer are disposed, the mass being drawn through the portion into the one of the pyrotechnic material and primer due to the biasing to ignite the one of the pyrotechnic material and primer.

13. The method of claim 12, further comprising delaying the drawing until the mass element experiences a set forward acceleration.

14. The method of claim 13, wherein the delaying comprises drawing the mass element into a delay well after the mass element traverses the inclined surface and drawing the mass element across a delay wedge when the mass element experiences the set forward acceleration.

15. The method of claim 12, further comprising directing a flame resulting from the mass element contact with one of the pyrotechnic material and primer to a thermal battery.

* * * * *